United States Patent [19]

Webinger

[11] 4,451,001

[45] May 29, 1984

[54] WRAP AROUND SLEEVE FOR TAPERED TUB

[75] Inventor: George P. Webinger, Robbinsdale, Minn.

[73] Assignee: Champion International Corporation, Stamford, Conn.

[21] Appl. No.: 402,775

[22] Filed: Jul. 28, 1982

[51] Int. Cl.[3] ..... B65D 5/06

[52] U.S. Cl. ..... 229/40; 206/434; 229/31 R

[58] Field of Search ..... 229/30, 31 R, 40, 87 F, 229/31 FS; 206/434, 427, 140, 491

[56] References Cited

U.S. PATENT DOCUMENTS

| | | | |
|---|---|---|---|
| 3,705,681 | 12/1972 | Rossi et al. | 229/40 |
| 4,128,169 | 12/1978 | Arneson | 206/434 X |
| 4,382,505 | 5/1983 | Sutherland et al. | 206/434 X |

FOREIGN PATENT DOCUMENTS

| | | | |
|---|---|---|---|
| 2457221 | 1/1981 | France | 229/31 R |
| 1380240 | 1/1975 | United Kingdom | 206/434 |

*Primary Examiner*—William T. Dixson, Jr.
*Assistant Examiner*—Gary E. Elkins
*Attorney, Agent, or Firm*—Evelyn M. Sommer; William W. Jones

[57] ABSTRACT

A sleeve is formed from sheet material, such as paperboard or the like, which sleeve is adapted to be wrapped about a tub having a tapered side wall. The sleeve is formed with two pairs of opposed side walls. One pair of the opposed side walls has the same taper as the wall of the tub and the other pair of opposed side walls is perpendicular to the top and bottom panels of the sleeve. The tub engages tuck flaps on the sleeve to hold the sleeve in place on the tub. The sleeved tubs can be stacked on their tops, bottoms, or on the perpendicular side walls.

2 Claims, 6 Drawing Figures

WRAP AROUND SLEEVE FOR TAPERED TUB

This invention relates to a sleeve formed from sheet material which is adapted to be wrapped around and contain a round tub of material, which tub is formed with a tapered side wall and may contain such materials as butter, cheese, or any other soft material commonly packed in tubs.

Soft materials such as butter, cheese, or the like are commonly packed in round tubs for retail consumption. Such tubs are usually provided with a tapered side wall with the bottom wall of the tub being smaller than the top closure. The tubs may be formed from resinous material, foil, or other suitable material. In order to prevent accidental opening of the tub, and to provide for increased graphics, tubs of the type described above are often individually wrapped in a sleeve formed from sheet material, such as paperboard or the like. Bulk stacking of such tubs is limited due to the tapered side wall of the tubs, and the fact that the sleeves will also include tapered side walls conforming in taper to the taper of the tub side wall. Such sleeves are usually open ended thereby requiring particular display orientation in order to make proper use of the graphics printed on the side walls of the sleeves.

The sleeve of this invention is formed from sheet material, such as paperboard, which has been cut and scored in a one-piece blank. The sleeve has top and bottom walls which overlie the top and bottom surfaces of the tub respectively. The sleeve also has two pairs of side walls, with the side walls in one pair being tapered so as to closely overlie the side wall of the tub, and with the side walls of the other pair being perpendicular to the top and bottom walls of the tub. The perpendicularity of the second pair of side walls provides several advantages. It enables the sleeved tubs to be stacked in bulk on those perpendicular side walls, an option which is not available when the side walls of the sleeve are all tapered, and it also provides additional space for printed graphics on the sleeve. With the additional graphics, it will be readily appreciated that the sleeved tubs can be stacked on retail shelves without the need to orient them in any particular manner. The sleeve is provided with tuck flaps which are tucked inside the sleeve when the tub is in place. The tuck flaps are foldably connected to the perpendicular pair of side walls and are engaged by the tub so as to hold the perpendicular side walls in their proper positions.

It is, therefore, an object of this invention to provide a sleeve formed from sheet material, such as paperboard, which is cut and scored and folded about a circular tub having a tapered side wall, which sleeve is provided with maximum side wall surface for display of graphics.

It is an additional object of the invention to provide a sleeve of the character described wherein one pair of side walls on the sleeve have a taper which is complimentary to the taper of the tub side wall, and a second pair of side walls on the sleeve are perpendicular to the top and bottom walls of the sleeve.

It is yet another object of the invention to provide a sleeve of the character described having tuck flaps foldably connected to the perpendicular side walls and tucked into the sleeve for engagement by the tub to hold the perpendicular side walls in proper position.

These and other objects and advantages of the invention will become more readily apparent from the following detailed description of a preferred embodiment thereof taken in conjunction with the accompanying drawings, in which.

Figure 1:
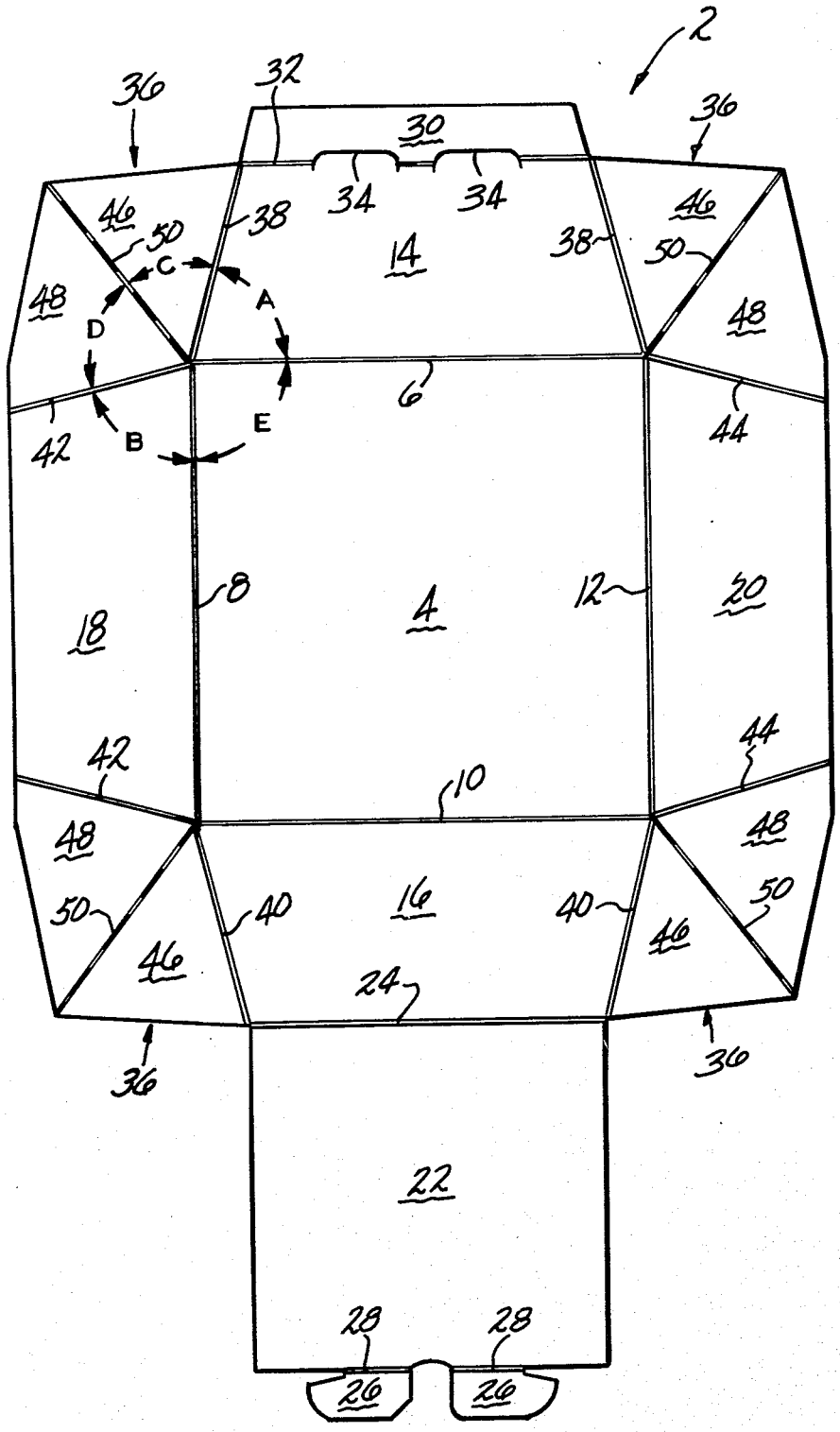
FIG. 1 is a plan view of a cut and scored blank of sheet material for forming a preferred embodiment of the sleeve of this invention.

Referring now to the drawings, there is shown in FIG. 1 a preferred embodiment of a cut and scored blank, preferably of paperboard, which blank is denoted generally by the numeral 2. The blank 2 includes a top wall panel 4 having side edges defined by fold lines 6, 8, 10 and 12. A first pair of side wall panels 14 and 16 are connected to the top wall panel 4 by means of the fold lines 6 and 10 respectively, and a second pair of side wall panels 18 and 20 are connected to the top wall panel 4 by fold lines 8 and 12 respectively. A bottom wall panel 22 is foldably connected to the side wall panel 16 by a fold line 24. It will be noted that the top wall panel 4 is larger in area than the bottom wall panel 22. A pair of locking tabs 26 are connected to the bottom wall panel 22 by fold lines 28. A closure flap 30 is foldably connected to the top wall panel 4 by a fold line 32 and a pair of slots 34 are cut in the fold line 32. Corner panels 36 are foldably connected to the side edges of the side wall panels 14, 16, 18 and 20 by fold lines 38, 40, 42 and 44 respectively. Each corner panel 36 is subdivided into a pair of tuck panels 46 and 48 by a fold line 50. Referring to the upper left hand corner portion of FIG. 1, it will be noted that the fold lines 6, 8, 38, 42 and 50 meet at a point to define five adjacent angles which, when added together total 360°. When the sleeve is erected, the first side wall panels 14 and 16 will lie in downwardly and inwardly tapered planes, and the second side wall panels 18 and 20 will be disposed perpendicular to the top and bottom wall panels 4 and 22 respectively. In order to ensure the perpendicularity of the second side wall panels 18 and 20 the angles C and D must be properly selected, as follows. As previously noted the sum of the angles A+B+C+D+E equals 360°. The angle E is a ninety degree angle. The angles A and B are equal angles with the size of these angles being determined by the degree of taper of the first side wall panels 14 and 16, which, in turn, is a function of the degree of taper of the side wall of the tub to be encased in the sleeve. Once the angles A and B are selected, the remaining angles D and C are determined from the following formuli:

$$C + D = 360° - (A + B + E)$$

$$\frac{90° - (A \text{ or } B)}{2} + \frac{C + D}{2} = D$$

$$(C + D) - D = C$$

It is noted that the angle D will always be larger than the angle C, and the specific values of each of these angles will be determined as outlined above. It will be appreciated that all of the corner panels 36 and tuck panels 46 and 48 are laid out in accordance with the above procedure.

Figure 2:
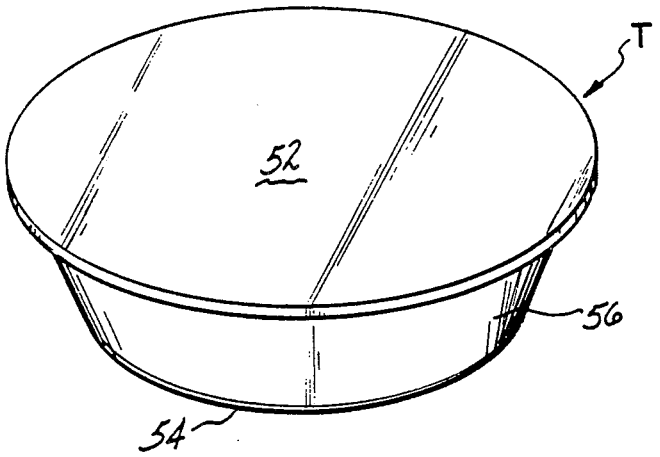
FIG. 2 is a perspective view of a typical tub which is packaged in the sleeve of this invention.

Referring now to FIG. 2, there is shown a typical tub which the sleeve of this invention is designed to enclose. The tub T has a circular top 52, a circular bottom 54, and an upwardly and outwardly tapered side wall 56. It will be noted that, although the tub T is usually round, it could have other than round configurations with a tapered side wall or side walls and still be wrapped in the sleeve of this invention.

Figure 3:
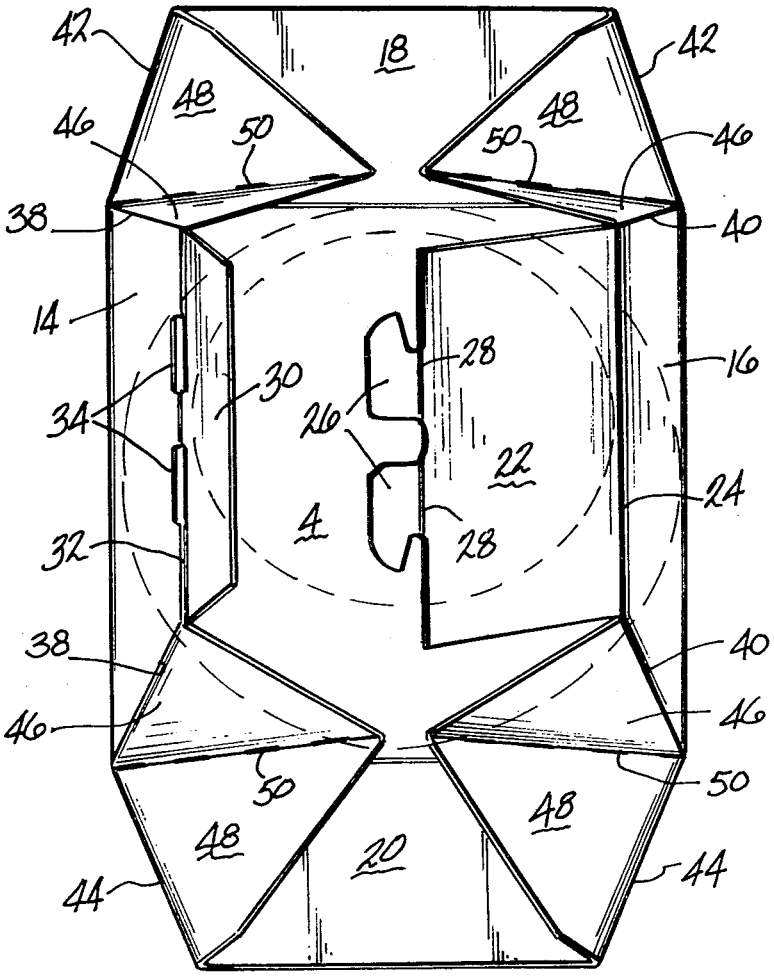
FIG. 3 is a perspective view of the partially erected sleeve of this invention prior to tucking and erecting the perpendicular side walls thereof.

Referring now to FIG. 3, the first step in erecting the sleeve is shown. It will be noted that the partially erected sleeve is shown in perspective with the bottom wall 22 facing the viewer for clarity. The tub T is positioned with its top centered on the top wall 4 of the sleeve. Side walls 18 and 20 and tuck panels 46 and 48 at the four corners of the sleeve are simultaneously folded inward toward the tub. This action causes the second set of side walls 14 and 16 and the bottom panel 22 to be brought up to a position paralleling the sides of the tub thereby trapping the four tuck panels between the side walls 14 and 16 and the sides of the tub. Finally, the bottom panel 22 is brought across the bottom of the tub and the tabs 26 are inserted into the slots 34 to lock the sleeve in position.

Figure 4:
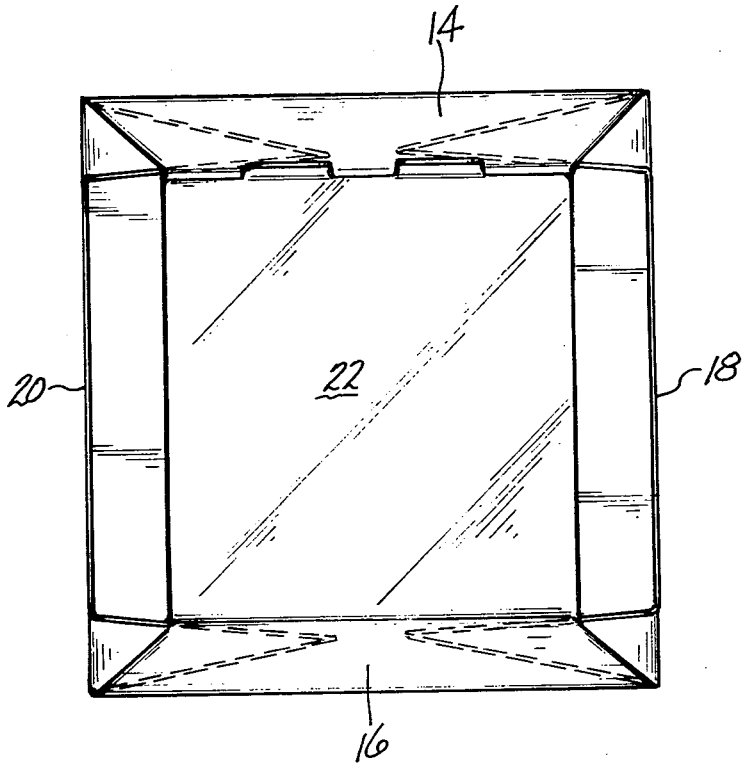
FIG. 4 is a perspective view similar to FIG. 3 but showing the initial folding step in erecting the perpendicular side walls.
Figure 5:
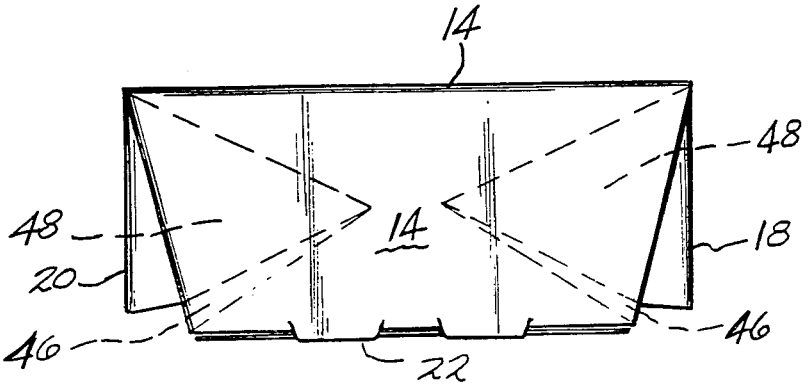
FIG. 5 is a side elevational view of the erected sleeve as seen looking at the tapered side walls.

Referring now to FIG. 4, the next step in erecting the sleeve is shown. Each of the tuck panels 46 and 48 at the four corners of the sleeve are folded in along their respective fold lines 38, 40, 42, 44 and 50. This infolding is continued until the tuck panels 46 and 48 are back folded inside of the sleeve and are in face-to-face contact with each other, and the tuck panels 46 are in face-to-face contact with the inner surface of the tapered side walls 14 and 16, as shown in FIG. 5. This latter position can be described as the tuck position for the tuck panels 46 and 48. When the tuck panels 46 and 48 are in the tuck position, the second end walls 18 and 20 are drawn down into a position which is perpendicular to the top and bottom walls 4 and 22 respectively, as shown in FIG. 5. It will be appreciated that the tuck panels 46 and 48, when in the tucked positions, are sandwiched between the tapered side walls 14 and 16 of the sleeve on one hand, and the tapered side wall of the tub, on the other. Thus the tuck panels 46 and 48 are securely held in their tuck positions, and the perpendicular side walls 18 and 20 are also securely held in their perpendicular positions, until the sleeve is opened to remove the tub.

Figure 6:
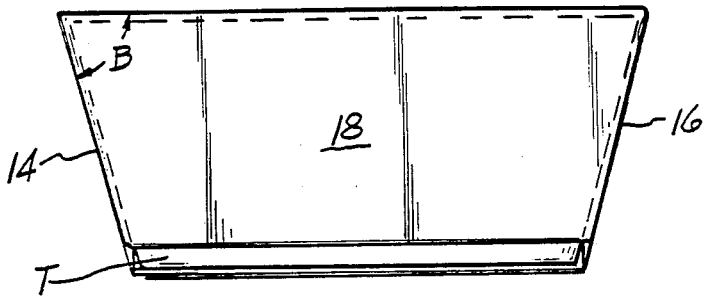
FIG. 6 is a side elevational view of the erected sleeve as seen looking at the perpendicular side walls.

Referring to FIG. 6, the taper of the side walls 14 and 16 is clearly shown conforming to the taper of the side wall of the tub T. It can also be seen that the angle B conforms to the angle of taper of the side wall of the tub. It is readily apparent that the perpendicular side walls 18 and 20 will provide substantial additional space for graphics. Referring to FIGS. 5 and 6 it is also readily apparent that the sleeved tubs can be stacked on their bottom and top walls, and can also be stacked on the perpendicular end walls.

It will be noted that the sleeve of this invention provides improved packaging for tapered side wall tubs, provides for additional graphics display, and allows improved stacking for bulk supplies of the sleeved tubs. The sleeve of this invention can be formed for a range of tapered side wall tubs merely by measuring the acute angle of taper of the tub and applying the formuli set forth above to determine the remaining angles necessary for properly forming the tuck panels.

Since many changes and variations of the disclosed embodiment of the invention may be made without departing from the inventive concept, it is not intended to limit the invention otherwise than as required by the appended claims.

What is claimed is:

1. A sleeve for encasing an article having a tapered side wall, said sleeve being formed from sheetstock material and comprising:

(a) a top wall having side edges;

(b) a pair of first side walls, one of each being foldably connected to opposite first side edges of said top wall, said first side walls tapering downwardly and inwardly from said first side edges of said top wall;

(c) a pair of second side walls, one of each being foldably connected to opposite second side edges of said top wall, said second side walls being substantially perpendicular to said top wall;

(d) a plurality of corner panels, one of each foldably interconnecting adjacent side edges of said first and second side walls, each of said corner panels being divided into a pair of associated tuck panels by a fold line, wherein C is an included angle between said fold line and a first fold connection between each of said corner panels and said first side walls; D is an included angle between said fold line and a second fold connection between each of said corner panels and said second side walls; A is an included angle between said first fold connection and a third fold connection between said first side walls and said top wall; B is an included angle between said second fold connection and a fourth fold connection between said second side walls and said top wall; and E is an included angle between said third and fourth fold connections; wherein A+B+C+D+E=360°; and wherein A and B are equal and are equal to the acute angle of taper of the side wall of the article to be encased in the sleeve; and wherein E equals 90°; and wherein C and D are determined by the following formuli:

$$C + D = 360° - (A + B + E)$$

$$\frac{90° - (A \text{ or } B)}{2} + \frac{C + D}{2} = D$$

$$(C + D) - D = C$$

said corner panels being folded along said fold line to position one of the tuck panels in each pair thereof in face-to-face contact with one of said first side walls whereby the perpendicularity of said second side walls is maintained; and (e) a bottom wall interconnecting bottom edges of said first side walls.

2. A blank of sheetstock material for forming a sleeve, said blank comprising:

(a) a top wall panel having side edges;

(b) a pair of first trapezoidal side wall panels, said first side wall panels being connected to a first pair of opposite side edges of said top wall panel along the longer of the parallel edges of said first side wall panels by first fold lines;

(c) a pair of second trapezoidal side wall panels, said second side wall panels being connected to a second pair of opposite side edges of said top wall panel along the longer of the parallel edges of said second side wall panels by second fold lines;

(d) a plurality of corner panels, each of said corner panels being foldably connected to one side edge one of said first side wall panels along third fold lines, and foldably connected to one side edge of one of said second side wall panels along fourth fold lines, and said corner panels being divided into adjacent tuck panels by fifth fold lines, said first, second, third, fourth and fifth fold lines meeting at each corner of said top wall panel to form adjacent included angles A, B, C, D and E the sum of which included angles equals 360°; wherein A is the angle between said first and third fold lines, B is the angle between said second and fourth fold lines, C is the angle between said third and fifth fold lines, D is the angle between said fourth and fifth fold lines, and E is the angle between said first and second fold lines and and is a 90° angle, and wherein A and B are equal known angles with angles C and D being determined by the following formuli:

$$C + D = 360° - (A + B + E)$$

$$\frac{90° - (A \text{ or } B)}{2} + \frac{C + D}{2} = D$$

$$(C + D) - D = C; \text{ and}$$

(e) a bottom wall panel connected to one of said first side wall panels along a fold line corresponding to the shorter of the two parallel edges of said one of said first side wall panels, said bottom wall panel being shorter in length and width than said top wall panel.

* * * * *